US006002745A

United States Patent [19]

Miller et al.

[11] Patent Number: 6,002,745

[45] Date of Patent: Dec. 14, 1999

[54] X-RAY TUBE TARGET ASSEMBLY WITH INTEGRAL HEAT SHIELDS

[75] Inventors: Robert S. Miller; Gregory Andrews, both of Sandy, Utah

[73] Assignee: Varian Medical Systems, Inc., Palo Alto, Calif.

[21] Appl. No.: 09/090,765

[22] Filed: Jun. 4, 1998

[51] Int. Cl.[6] ..... H01J 35/10

[52] U.S. Cl. ..... 378/128; 378/142

[58] Field of Search ..... 378/128, 142, 378/125, 144

[56] References Cited

U.S. PATENT DOCUMENTS

| | | | |
|---|---|---|---|
| 3,735,176 | 5/1973 | Langer et al. | 378/125 |
| 4,115,718 | 9/1978 | Eggelsmann | 378/128 |
| 4,901,338 | 2/1990 | Rödhammer et al. | 378/144 |

*Primary Examiner*—David P. Porta
*Assistant Examiner*—Allen C. Ho
*Attorney, Agent, or Firm*—Bradford L. Friedman; Bella Fishman

[57] ABSTRACT

A graphite-backed metallic x-ray tube target assembly has a rotary shaft which passes through the central opening of the annular graphite substrate and is secured to the metallic disk-shaped target. In order to protect the shaft from heat radiated from the graphite substrate, at least one tubular heat shield is brazed to the target and disposed between and separate from the inner wall of the annular graphite substrate and the outer peripheral surface of the shaft. For further protection, a tubular heat shielding member may be disposed inside the other heat shield, between the outer heat shield and the shaft. In order to minimize the heat conduction from the outer heat shield to the inner heat shielding member, they are mostly separated and attached to each other only along their bottom edges where they are tack-welded together at mutually separated positions such that the inner heat shielding member is supported entirely by the outer heat shield.

19 Claims, 1 Drawing Sheet

X-RAY TUBE TARGET ASSEMBLY WITH INTEGRAL HEAT SHIELDS

BACKGROUND OF THE INVENTION

This invention relates to an x-ray tube target assembly, and more particularly to a rotary metal-graphite composite target having integrally attached heat shields.

Rotary metal-graphite composite target assemblies for x-ray tubes have been known in prior art. For example, the U.S. Pat. No. 4,901,338, discloses this type of assembly, that comprises an annular graphite substrate which is secured to the back surface of a disk-shaped target made, for example, of a metal material such as tungsten, molybdenum or related alloys, such as TZM. A rotary shaft supported by bearings is secured to the disk-shaped target and passes through the central opening of the annular graphite substrate. Since the heat from the target can adversely affect the lifetime of the bearings and as a result the x-ray tube as a whole, the portion of outer surface of the shaft inside the annular graphite substrate is covered with a heat-insulating material. This protection is not sufficient to adequately shield the shaft and the bearings from the heat generated by the graphite substrate.

SUMMARY OF THE INVENTION

It is therefore an object of the present invention to provide a metal-graphite composite x-ray tube target assembly with the rotary shaft, where the rotary shaft is sufficiently protected from the heat radiated from a graphite substrate.

An x-ray tube target assembly embodying this invention, with which the above and other objects and advantages can be accomplished, comprises a shaft and a metal-graphite composite target with a metallic target disk secured to the shaft and an annular graphite substrate secured to the target disk. The annular graphite substrate has a central opening for passing the shaft therethrough. At least one tubular heat shield is disposed between an inner wall bounding the central opening and the portion of the outer surface of the rotary shaft. A top edge of the heat shield is attached to a back surface of the target disk forming an integral therewith. The top surface of the heat shield may have a plurality of protrusions of a predetermined shape which may be brazed to the back surface of the target disk. The heat shield is separated from both the rotary shaft and the graphite substrate so as to prevent heat transmission by conduction.

According to a preferred embodiment of the present invention, there is a tubular heat shielding member disposed concentrically and inside the tubular heat shield. In order to minimize the heat transmission through conduction, this inner tubular heat shielding member, as well as an outer tubular heat shield is separated from the portion of the outer surface of the rotary shaft. Mutually concentric heat shield and heat shielding member are mostly separated therebetween except that they are connected together at a plurality of isolated spots which are separated at intervals around the axis of the rotary shaft to form a common base.

Tubular heat shields separate the graphite substrate and the rotary shaft and prevent heat conduction therebetween. Transfer of heat by radiation is minimized substantially and the effective lifetime of the bearing for the rotary shaft, as well as the x-ray target assembly, can be significantly improved.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

DETAILED DESCRIPTION OF THE INVENTION

Figure 1:
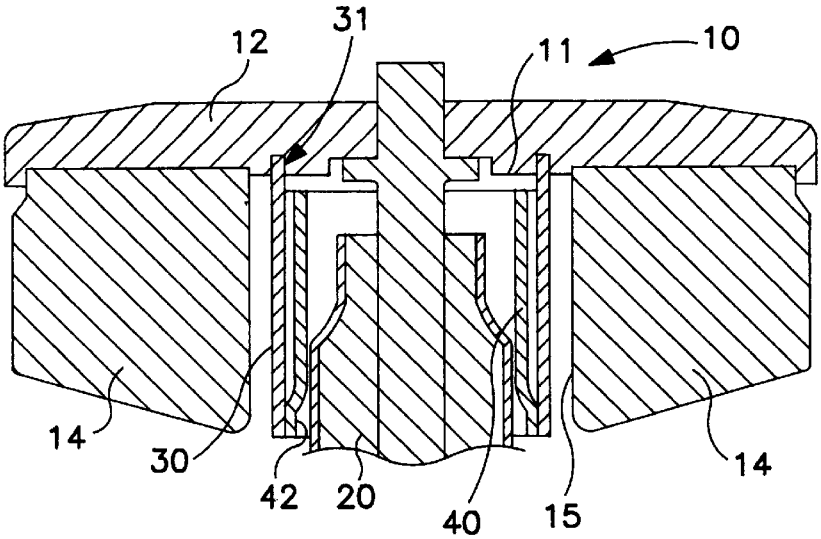
FIG. 1 is a sectional side view of an x-ray tube target embodying present invention.

FIG. 1 shows metal-graphite composite x-ray target assembly 10 having metallic disk 12 of a material such as tungsten, molybdenum or their alloys such as TZM. Annular graphite substrate 14 is secured to back surface 11 of metallic disk 12 in a coaxial relationship. Numeral 15 indicates the inner cylindrical wall of the graphite substrate 14 facing its central opening.

Rotary shaft 20, connected to a drive motor (not shown) and rotatably supported by a bearing (not shown) so as to rotate around its own axis, penetrates annular graphite substrate 14 through its central opening coaxially with cylindrical inner wall 15. Metallic disk 12 is secured to rotary shaft 20 in any of known methods, for example, by brazing, when the same brazing material is used for connecting metallic disk 12 with graphite substrate 14, so as to rotate with shaft 20. The portion of the outer surface of shaft 20 opposite to cylindrical inner wall 15 of annular graphite substrate 14 may be coated with a heat shielding material.

Figure 2:
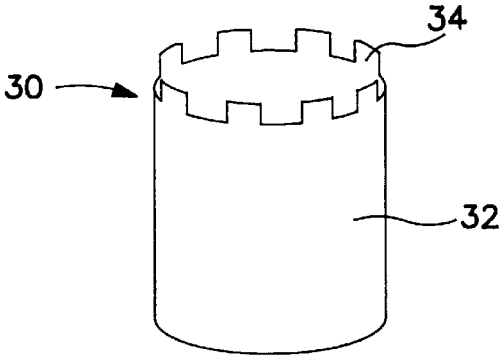
FIG. 2 is a perspective view of the outer heat shield shown in FIG. 1 having a plurality of rectangularly shaped protrusions according to one preferred embodiment of the present invention.
Figure 3:
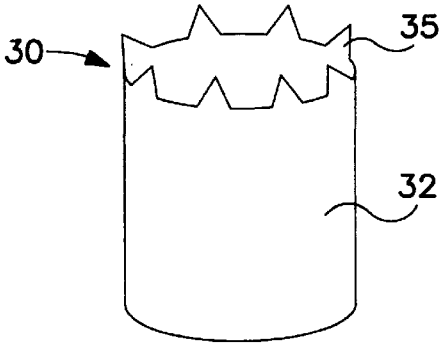
FIG. 3 is a perspective view of the outer heat shield shown in FIG. 1 having a plurality of triangularly shaped protrusions according to another preferred embodiment of the present invention.

In order to impede the radiative heat transfer from the graphite substrate 14 to shaft 20, a cross-sectionally circular tubular heat shield 30 is disposed coaxially with shaft 20 and also with cylindrical inner wall 15 of annular graphite substrate 14. The longitudinal dimension of the heat shield is comparable with the longitudinal dimension of the annular graphite substrate. Tubular heat shield 30 is separated from cylindrical inner wall 15 and shaft 20. Top end 31 of heat shield 30 is attached to back surface 11 of metallic disk 12 by brazing such that shield 30 is secured thereto and is adapted to rotate therewith. FIGS. 2 and 3 show heat shield 30 according to two embodiments of the present invention. Heat shield of FIG. 2 has substantially cylindrical main body 32 and a plurality of circumferentially equally spaced rectangular protrusions 34 extending in the axial direction from its edge at the top end of main body 32. Heat shield of FIG. 3 has a plurality of triangular protrusions 35. When heat shield 30 is secured to the back surface of disk 12, only protrusions 34 or 35 are brazed to disk 12 such that the heat conduction from disk 12 to heat shield 30 can be reduced. Protrusions 34 or 35 can be formed by removing edge portions of main body 32 to create the spaces between mutually adjacent pairs of protrusions 34 and 35 respectively.

As shown in FIG. 1, heat shielding member 40 is provided inside heat shield 30 and herein referred to as "inner heat shield 40" in order to distinguish it from shield 30 which will be hereinafter referred to as the outer heat shield. The inner heat shield 40 is also tubular and mostly cylindrical with a circular cross-sectional shape having a smaller radius than that of the outer heat shield 30. The inner heat shield 40 has an enlarged annular edge area 42 at the bottom that has outer radius which is comparable to the inner radius of outer heat shield 30.

The inner heat shield 40 is positioned inside outer heat shield 30 and coaxially therewith, and its enlarged annular edge area 42 is tack-welded to the inner surface of a bottom portion of outer heat shield 30 at a plurality of mutually isolated spots. This design allows to reduce substantially heat conduction from outer heat shield 30 to inner heat shield 40 while both shields are securely connected therebetween providing a gap between cylindrical main body 32 of outer heat shield 30 and the cylindrical portion of inner heat shield 40. The inner heat shield 40 is shorter than outer heat shield 30 longitudinally. As such, the top edge of inner heat shield 40 does not contact back surface 11 of metallic disk 12, and inner heat shield 40 being entirely supported by outer heat shield 30. The outer heat shield 30 and inner heat shield 40 may comprise a heat shielding material such as molybdenum or related alloys including TZM.

The invention has been described above by way of examples but these examples are not intended to limit the scope of the invention. Many modifications and variations are possible within the scope of the invention. The outer heat shield, for example, need not be entirely cylindrical and the radius of its tubular form may gradually increase longitudinally like the front end of a trumpet. The number of heat shields may be determined by a practical spacing between the rotary shaft and the cylindrical inner wall of the annular graphite substrate. Materials for the shields, the shaft and the target assembly may be appropriately changed.

The disclosure is intended to be interpreted broadly, and the drawings are not intended to represent practical dimensional relationships among components. All modifications and variations of the disclosure that may be apparent to a person skilled in the art are intended to be within the scope of this invention.

What is claimed is:

1. An x-ray tube target assembly comprising:

a shaft rotatable around a longitudinal axis thereof;

a target disk having a front and a back sides, said target disk mounted on said shaft for rotation therewith;

an annular graphite substrate positioned coaxial with said target disk and fixed to said back side thereof, said annular graphite substrate and having a central opening bounded by an inner wall for passing said shaft therethrough; and at least one heat shield disposed between and separated from said inner wall of said central opening and a portion of an outer surface of said shaft, a top surface of said at least one heat shield being fastened to said back side of said target disk.

2. The x-ray tube target assembly of claim 1, wherein said at least one heat shield has a longitudinal dimension comparable with a longitudinal dimension of said annular graphite substrate.

3. The x-ray tube of claim 2, further comprising at least one heat shielding member which is disposed between an inner wall of said at least one heat shield and said portion of said outer surface of said shaft and has a common base with said at least one heat shield, wherein gap is formed between a top portion of said shielding member and a back side of said target disk.

4. The x-ray tube of claim 2, wherein said heat shielding member has a longitudinal dimension smaller than the longitudinal dimension of said heat shield.

5. The x-ray tube target assembly of claim 2, wherein said at least one heat shield has a cylindrical shape.

6. The x-ray tube target assembly of claim 5, wherein said at least one heat shielding member has a substantially cylindrical shape.

7. The x-ray tube target assembly of claim 3, wherein said top surface of said at least one heat shield has a plurality of protrusions, and said back side of said target disk has an annular recess into which said protrusions project.

8. The x-ray tube target assembly of claim 7, wherein said protrusions have rectangular cross sections.

9. The x-ray tube target assembly of claim 7, wherein said protrusions have triangular cross sections.

10. The x-ray tube target assembly of claim 5, wherein said protrusions of said at least one heat shield is brazed to said back side of said target disk.

11. An x-ray tube target assembly comprising:

a shaft rotatable around a longitudinal axis thereof, said shaft having an outer surface;

a target disk mounted on said shaft so as to rotate therewith;

an annular graphite substrate having a central opening with an inner wall and being secured to said target disk, said rotary shaft passing through said central opening of said annular graphite substrate; and a tubular heat shield disposed between and separated from said inner wall of said central opening and a portion of said outer surface of said shaft, said tubular heat shield being fastened to said target disk.

12. The x-ray tube target assembly of claim 11, further comprising a tubular heat shielding member disposed between said tubular heat shield and said portion of outer surface of said shaft, and spaced apart from said shaft, said heat shielding member being supported entirely by said heat shield and separated from said heat shield except over an annular edge area opposite to said target disk and secured to said heat shield over said edge area.

13. The x-ray tube target assembly of claim 11, wherein said tubular heat shield is brazed to said target.

14. The x-ray tube target assembly of claim 12, wherein said heat shielding member is tack-welded to said heat shield at a plurality of isolated positions over said edge area.

15. The x-ray tube target assembly of claim 14, wherein said isolated positions are equally spaced around said shaft.

16. The x-ray tube target assembly of claim 12, wherein said heat shield and said heat shielding member comprise a heat shielding material selected from the group consisting of molybdenum and TZM.

17. The x-ray tube target assembly of claim 16, wherein said heat shield and said heat shielding member are substantially concentric cylinders except over and near said edge area.

18. The x-ray tube target assembly of claim 11, wherein said heat shield is a tantalum cylinder having protrusions extending longitudinally from one edge thereof, said protrusions being brazed to said target disk around said shaft.

19. The x-ray tube target assembly of claim 18, wherein said protrusions are parallel to said longitudinal axis and mutually separated at equal intervals around said shaft.

* * * * *